US006625979B2

(12) United States Patent
Sugaya et al.

(10) Patent No.: US 6,625,979 B2
(45) Date of Patent: Sep. 30, 2003

(54) DOUBLE PIPE EXHAUST MANIFOLD

(75) Inventors: Daisuke Sugaya, Tokyo (JP); Katsumi Amada, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/084,343

(22) Filed: Feb. 28, 2002

(65) Prior Publication Data

US 2002/0139115 A1 Oct. 3, 2002

(30) Foreign Application Priority Data

Mar. 28, 2001 (JP) ..... 2001-092609

(51) Int. Cl.[7] ..... F01N 7/10
(52) U.S. Cl. ..... 60/323; 60/322
(58) Field of Search ..... 60/322, 323; 138/149, 138/155, 157, 171

(56) References Cited

U.S. PATENT DOCUMENTS 4,404,992 A * 9/1983 Sasaki et al. ..... 138/149
5,004,018 A * 4/1991 Bainbridge ..... 138/149
5,419,127 A * 5/1995 Moore, III ..... 60/322
5,682,741 A * 11/1997 Augustin et al. ..... 60/323
5,761,905 A * 6/1998 Yamada et al. ..... 60/323
5,953,912 A * 9/1999 Kaiho et al. ..... 60/323
6,155,046 A 12/2000 Kato et al.
6,245,301 B1 * 6/2001 Stroom et al. ..... 422/179
6,247,552 B1 * 6/2001 Kovar et al. ..... 60/323

FOREIGN PATENT DOCUMENTS

| | | | |
|---|---|---|---|
| DE | 34 32 744 A1 | | 3/1986 |
| DE | 39 22 667 A1 | | 9/1990 |
| DE | 199 17 604 A1 | | 12/2000 |
| EP | 0 582 985 A1 | | 2/1994 |
| GB | 2 122 683 A | | 1/1994 |
| JP | 58-104318 | * | 6/1983 |
| JP | 62-99612 | * | 5/1987 |

* cited by examiner

*Primary Examiner*—Thomas Denion
*Assistant Examiner*—Tu M. Nguyen
(74) *Attorney, Agent, or Firm*—Foley & Lardner

(57) ABSTRACT

Disclosed is a double pipe exhaust manifold having an inner pipe, a mesh spacer member applied to the outer periphery of the inner pipe, and an outer pipe being disposed around the outer periphery of the mesh spacer member in a state that the outer pipe is axially slidable at least to the inner pipe, wherein the outer pipe is divided into two pipe members, and one side end of one of the divided pipe members is put on the corresponding one of the other of the divided pipe members as radially viewed, and the other side end of the divided pipe member is put on the corresponding one of the latter divided pipe member, and the overlapping portions are welded together.

12 Claims, 4 Drawing Sheets

DOUBLE PIPE EXHAUST MANIFOLD

BACKGROUND OF THE INVENTION

The present invention relates to a double pipe exhaust manifold which is interposed between an engine and a catalyst and in which an adiabatic outer pipe is disposed around an inner pipe through which exhaust gas passes in a state that a mesh spacer member is interposed between those pipes, whereby an adiabatic space is formed between the inner pipe and the outer pipe.

It is a common practice that the exhaust manifold, as shown in FIG. 6, has a double pipe structure including an inner pipe 101 and an adiabatic outer pipe 102 covering the outer periphery of the inner pipe, in order that a catalyst located in the midway of the exhaust system of an engine early exercises its purifying function by rapidly heating up the catalyst to facilitate the purifying performance of the vehicle by utilizing the heat of the exhaust gas. A mesh spacer member 103 is interposed between the inner pipe 101 and the outer pipe 102 to secure the adiabatic space. Since the mesh spacer member 103 is brought into contact with the inner pipe 101 and the outer pipe 102, a mesh consisting of wires each having a small diameter of about 0.25 mm is used for the mesh spacer member 103 so as to minimize its thermal conduction.

To give the inner pipe 101 a function of absorbing a thermal expansion difference between the inner pipe 101 and the outer pipe 102, which results from a thermal expansion difference and a thermal expansion coefficient between the inner pipe and the outer pipe, the inner pipe 101 consists of two pipe members coupled so as to allow those members to axially extend and shrink. The mesh spacer member 103 is fixed only to the inner pipe 101, and the outer pipe 102 and the mesh spacer member 103 are coupled such that those are slidable in the axial direction.

The outer pipe 102 is divided into two pipe members in the radial direction in the light of the assembling of the outer pipe 102 to the inner pipe 101. To assemble the outer pipe to the inner pipe 101, the divided outer pipe members 102*a* and 102*b* are both brought into contact with the outer periphery of the mesh spacer member 103 outside the inner pipe 101. In this state, one side end of the divided outer pipe member 102*a* is put on the corresponding side end of the divided outer pipe member 102*b*. The other side end of the former is also put on the corresponding one of the latter. Those overlapping portions of the divided outer pipe members 102*a* and 102*b* are bonded, by welding 104, into one cylindrical member. In this way, the outer pipe is assembled to the inner pipe 101.

In the conventional double pipe exhaust manifold, as described above, in a state that both the divided outer pipe members 102*a* and 102*b* are brought into contact with the outer peripheral surface of the mesh spacer member 103, those overlapping portions of the outer pipes 102*a* and 102*b* are bonded together by the welding 104. When the overlapping portions are welded together, a back bead 104*a* of the welding 104 comes in contact with the mesh spacer member 103. In this condition, the mesh spacer member 103 formed with fine wires of 0.25 mm in diameter is cut by high heat of the back bead 104*a*. As a result, there is the possibility that the mesh of the mesh spacer member starts to be broken from its cut part, and is loosened. The back bead 104*a* may be welded onto the mesh spacer member 103 although the mesh is not cut. In this case, the axially sliding motion of the outer pipe 102 to the inner pipe 101 will be impeded or break the mesh spacer member 103. The above problems may be solved in a manner that the outward flanges are formed at both side ends of the divided outer pipe members, and those flanges are welded together at the tips of them. In this approach, the outward flanges greatly project to the right and left from the outer pipe. Accordingly, the outside diameter of the exhaust manifold is increased by an amount corresponding to the flange projection. This results in deterioration of the on-board property.

SUMMARY OF THE INVENTION

It is an object of the present invention to provide a double pipe exhaust manifold which is able to prevent such an unwanted situation that during the assembling work by the welding of the divided outer pipe members forming the cylindrical outer pipe, the back bead comes in contact with the mesh spacer member, and the mesh spacer member is cut or the mesh spacer member is welded to the outer pipe by high heat of the back bead, without the deterioration of the on-board property.

The aforementioned object is achieved by means of a double pipe exhaust manifold having an inner pipe, a mesh spacer member applied to the outer periphery of the inner pipe, and an outer pipe being disposed around the outer periphery of the mesh spacer member in a state that the outer pipe is axially slidable to the inner pipe, wherein the outer pipe is divided into two pipe members in a radial direction, and one side end of one of the divided pipe members is put on the corresponding one of the other of the divided pipe members, and the other side end of the divided pipe member is put on the corresponding one of the latter divided pipe member in a radial direction, and the overlapping portions are welded together, the improvement being characterized in that the overlapping portions of the pipe members are swollen to the outside to form gaps between the overlapping portions and the mesh spacer member.

Preferably, the inner pipe is thinner than the outer pipe, and the mesh spacer member is fastened to the inner pipe by spot welding.

As described, in the invention, the overlapping portions of the pipe members are swollen to the outside to form gaps between the overlapping portions and the mesh spacer member. Accordingly, it is avoided that the back bead of the welding comes in contact with the mesh spacer member when one side end of one of the divided pipe members is put on the corresponding one of the other of the divided pipe members as radially viewed, and the other side end of the divided pipe member is put on the corresponding one of the latter divided pipe member, and in this state the overlapping portions are welded together.

The double pipe exhaust manifold of the invention successfully prevents such an unwanted situation that the back bead at high temperature comes in contact with the mesh spacer member, and hence the mesh spacer member is cut and the mesh spacer member is welded to the outer pipe.

It suffices that gaps between the overlapping portions and the mesh spacer member are minute (≈2 mm). Accordingly, there is no chance that the outside diameter of the exhaust manifold is increased and the on-board property is deteriorated.

In the preferred embodiment, the inner piper is thinner than the outer pipe, so that the mesh spacer member may be fastened to the inner pipe by spot welding. In the spot welding, temperature during the welding is lower than that in the cladding by welding. Therefore, the mesh spacer member may easily be fastened without the cutting of the mesh of the mesh spacer member.

Since the inner pipe is formed to have a thin thickness, a thermal capacity of it is small. Accordingly, it is prevented that heat is absorbed by the inner pipe and exhaust gas temperature reduces. Further, the outer pipe is formed to have a thick thickness, so that the durability of the double pipe exhaust manifold is increased.

BRIEF DESCRIPTION OF THE DRAWINGS

FIG. 1 is a diagram showing a whole exhaust system of an engine into which a double pipe exhaust manifold of an embodiment of the invention is incorporated.

FIG. 2 is an enlarged, longitudinal sectional view showing a key portion of the double pipe exhaust manifold of the invention.

FIG. 3 is a longitudinal sectional view taken on line III—III in FIG. 2.

FIG. 4 is a transverse sectional view taken on line III—III in FIG. 2.

FIG. 5 is a diagram showing another instance of a mesh spacer member.

FIG. 6 is a transverse sectional view showing a conventional double pipe exhaust manifold.

DETAILED DESCRIPTION OF THE PREFERERED EMBODIMENTS

A double pipe exhaust manifold which is an embodiment of the present invention is defined as in aspects 1 and 2.

A construction of the double pipe exhaust manifold of the embodiment will be described with reference to the accompanying drawings.

Figure 1:
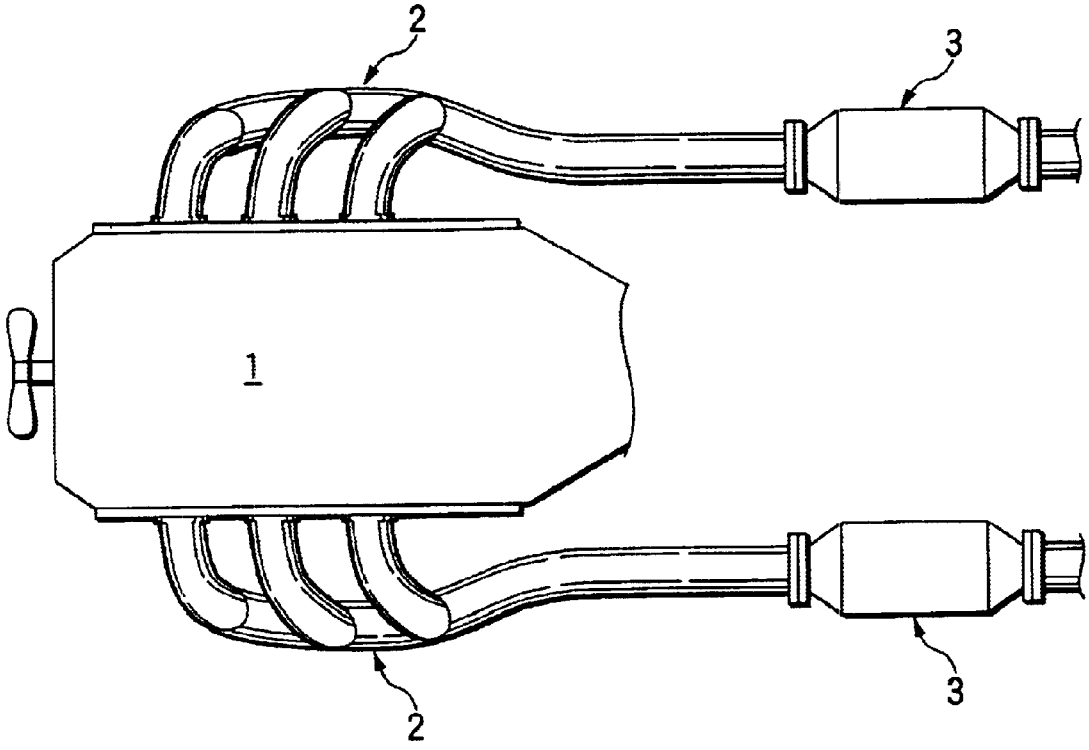
[FIG. 1]
Figure 2:
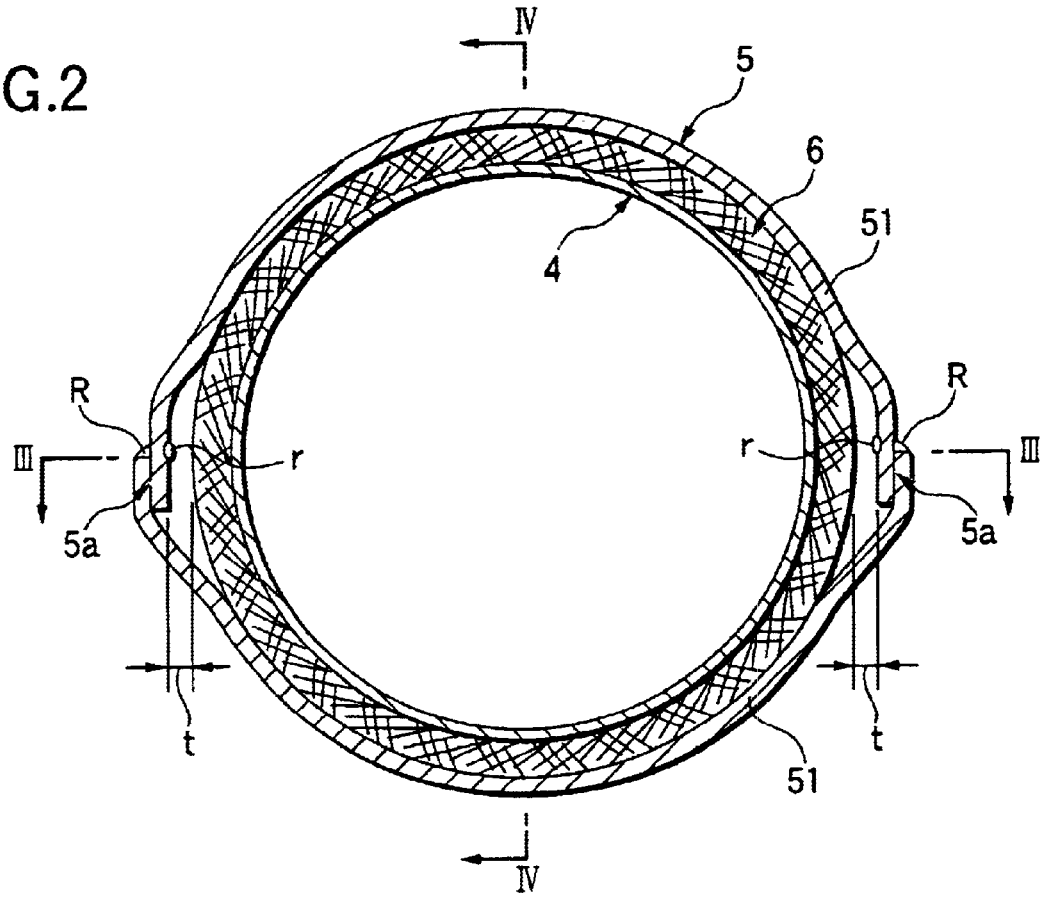
[FIG. 2]
Figure 3:
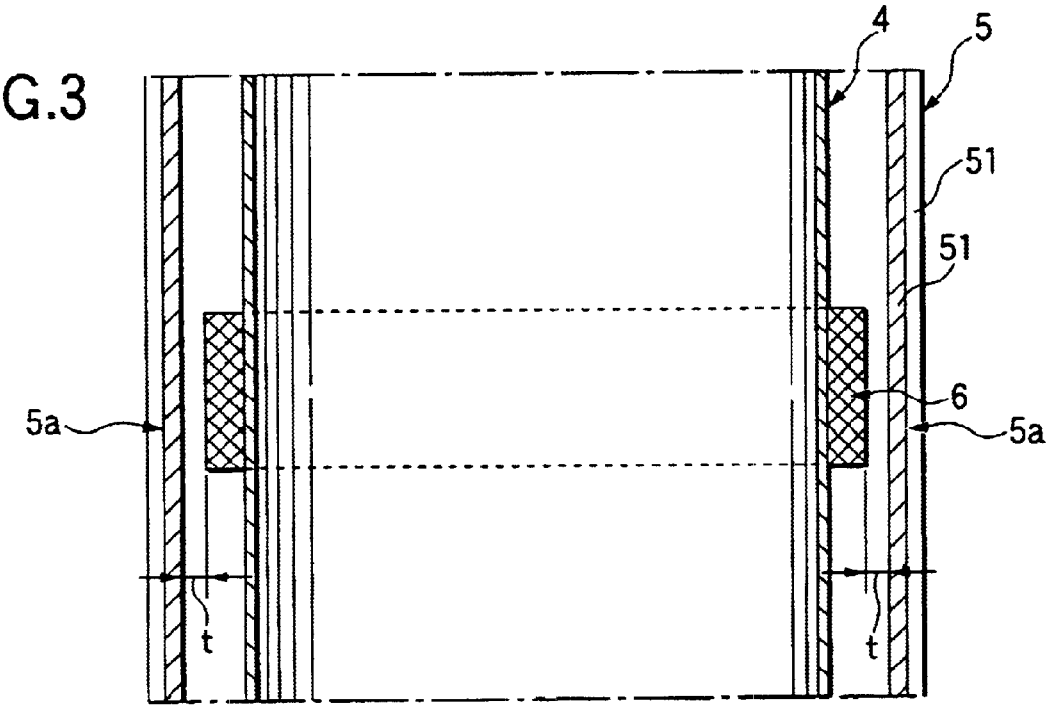
[FIG. 3]
Figure 4:
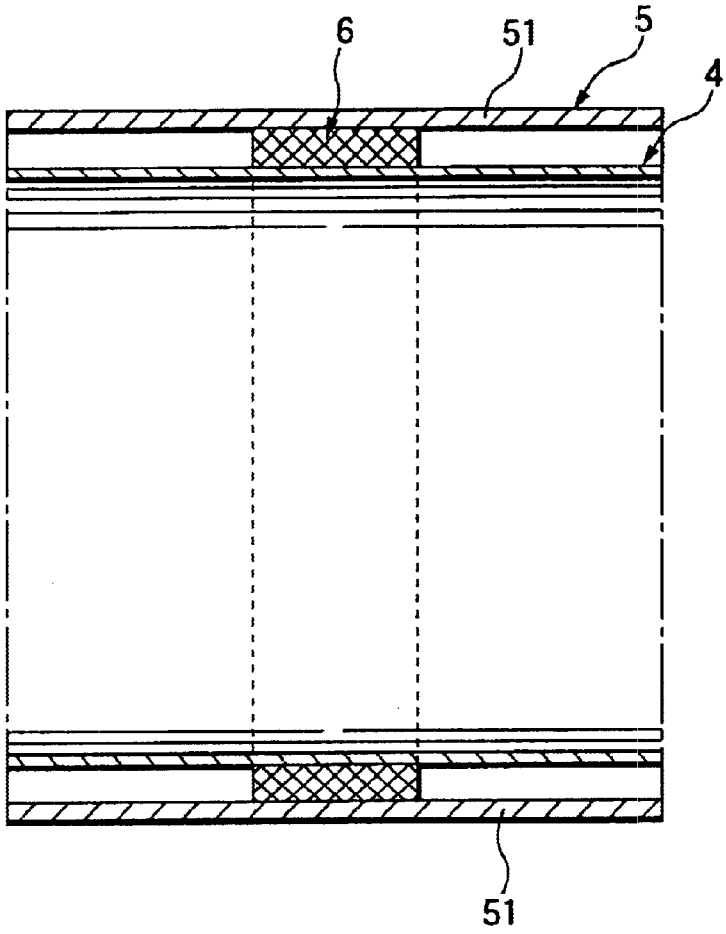
[FIG. 4]

FIG. 1 is a diagram showing a whole exhaust system of an engine into which a double pipe exhaust manifold of an embodiment of the invention is incorporated. FIG. 2 is an enlarged, longitudinal sectional view showing a key portion of the double pipe exhaust manifold of the invention. FIG. 3 is a longitudinal sectional view taken on line III—III in FIG. 2. FIG. 4 is a transverse sectional view taken on line IV—IV in FIG. 2. In those figures, reference numeral 1 is a V-6 cylinder engine; 2 is a double pipe exhaust manifold; 3 is a catalyst; 4 is a manifold container; 5 is an outer pipe; and 6 is a mesh spacer member.

Specifically, the double pipe exhaust manifold 2 of the embodiment according to the invention is placed in an exhaust system extending between the V-6 cylinder engine 1 and the catalyst 3. In the present embodiment, the double pipe exhaust manifolds are located on both sides of the V-6 cylinder engine 1, and are respectively provided with the catalyst 3.

More specifically, the double pipe exhaust manifold, as shown in FIG. 1, has a double pipe structure including an inner pipe 4 and an adiabatic outer pipe 5 covering the outer periphery of the inner pipe, in order that a catalyst 3 (FIGS. 2 to 4) located in the midway of the exhaust system of an engine early exercises its purifying function by rapidly heating up the catalyst to facilitate the purifying performance of the vehicle by utilizing the exhaust gas exhausted from the V-6 cylinder engine 1. A mesh spacer member 6 is interposed between the inner pipe 4 and the outer pipe 5 to secure the adiabatic space. Since the mesh spacer member 6 is brought into contact with the inner pipe 4 and the outer pipe 5, a mesh consisting of wires each having a small diameter of about 0.25 mm is used for the mesh spacer member 6 so as to minimize its thermal conduction.

As shown in FIGS. 2 to 4, the inner pipe 4 is formed with a pipe member, circular in cross section, which is made of stainless and has a thin thickness (thickness: 0.5 to 0.8 mm). The outer pipe 5 consists of two divided outer pipe members 51 which are pipes formed as if the outer pipe 5 is vertically (radially) divided into two pipe members. Each divided outer pipe members 51 is manufactured by pressing a stainless steel plate having a thick thickness (1.5 to 2.0 mm), and is shaped to be semicircular in cross section. One side end of the first divided outer pipe member 51 is put on the corresponding side end of the second divided outer pipe 51. The other end of the former is also put on the corresponding one of the latter. Those overlapping portions 5*a* of the divided outer pipe members are bonded, by welding, into one cylindrical member.

In the double pipe exhaust manifold, the overlapping portions 5*a* of the pipe members 51 are somewhat swollen to the outside to form gaps (≈2 mm) "t" between the overlapping portions 5*a* and the mesh spacer member 6.

The double pipe exhaust manifold 2 is thus constructed in the embodiment of the invention. Accordingly, to assemble the exhaust manifold, the mesh spacer member 6 is first set at a predetermined location on the outer periphery of the inner pipe 4, and the mesh spacer member 6 is spot welded to the outer periphery of the inner pipe 4.

Then, the divided outer pipe members 51 are brought into contact with the outer periphery of the mesh spacer member 6 outside the inner pipe 4, and the mesh spacer member 6 is pressed, by small pressing force, against the outer periphery to be in compressed state. In this state, one side end of the first said divided pipe member is put on the corresponding one of the second divided pipe member as radially viewed, and the other side end of the first divided pipe member 51 is put on the corresponding one of said second divided pipe member 51. The overlapping portions 5*a* of the divided outer pipe members 51 are welded (denoted as R) together into a cylindrical outer pipe 5. Here, the assembling work of the double pipe exhaust manifold 2 is completed.

In the exhaust manifold 2 of the embodiment, the overlapping portions 5*a* of the pipe members 51 are swollen to the outside to form gaps "t" between the overlapping portions 5*a* and the mesh spacer member 6. Accordingly, it is avoided that the back bead "r" of the welding "R" comes in contact with the mesh spacer member 6 when one side end of one of the divided pipe members 51 is put on the corresponding one of the other of the divided pipe members 51 as radially viewed, and the other side end of the divided pipe member 51 is put on the corresponding one of the latter divided pipe member 51, and in this state the overlapping portions 5*a* are welded together.

Accordingly, it is prevented that the back bead "r" at high temperature comes in contact with the mesh spacer member, and as a result, the mesh spacer member is cut and the mesh spacer member 6 is welded to the outer pipe 5.

It suffices that gaps between the overlapping portions 5*a* of the divided outer pipe members 51 and the mesh spacer member 6 are minute (≈2 mm). Accordingly, there is no chance that the outside diameter of the exhaust manifold is increased and the on-board property is deteriorated.

As described above, the inner piper 4 is thinner than the outer pipe 5, so that the mesh spacer member 6 maybe fastened to the inner pipe 4 by spot welding. In the spot welding, temperature during the welding is lower than that in the cladding by welding "R". Therefore, the mesh spacer member 6 may easily be fastened without the cutting of the mesh of the mesh spacer member.

Since the inner pipe 4 is formed to have a thin thickness, a thermal capacity of it is small. Accordingly, it is prevented that heat is absorbed by the inner pipe 4 and exhaust gas temperature reduces. Further, the outer pipe 5 is formed to have a thick thickness, so that the durability of the double pipe exhaust manifold is increased.

While the present invention has been described using the specific embodiment, it should be understood that the invention is not limited to the above-mentioned embodiment, but may variously be modified, altered and changed in design within the scope and true spirits of the invention.

Figure 5:
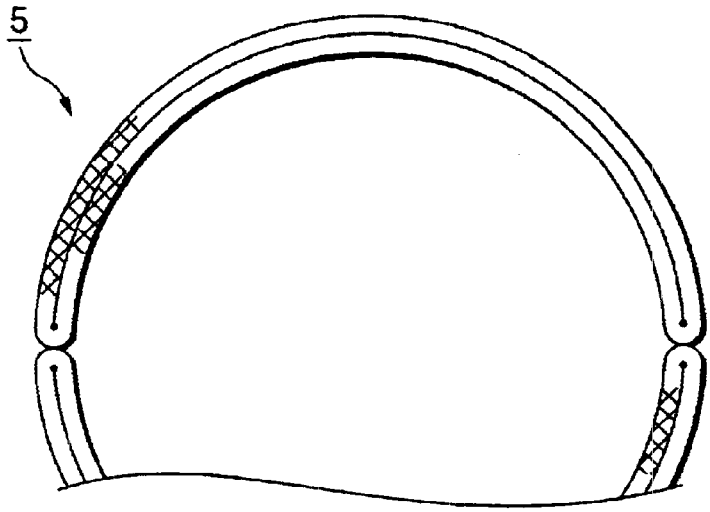
[FIG. 5]
Figure 6:
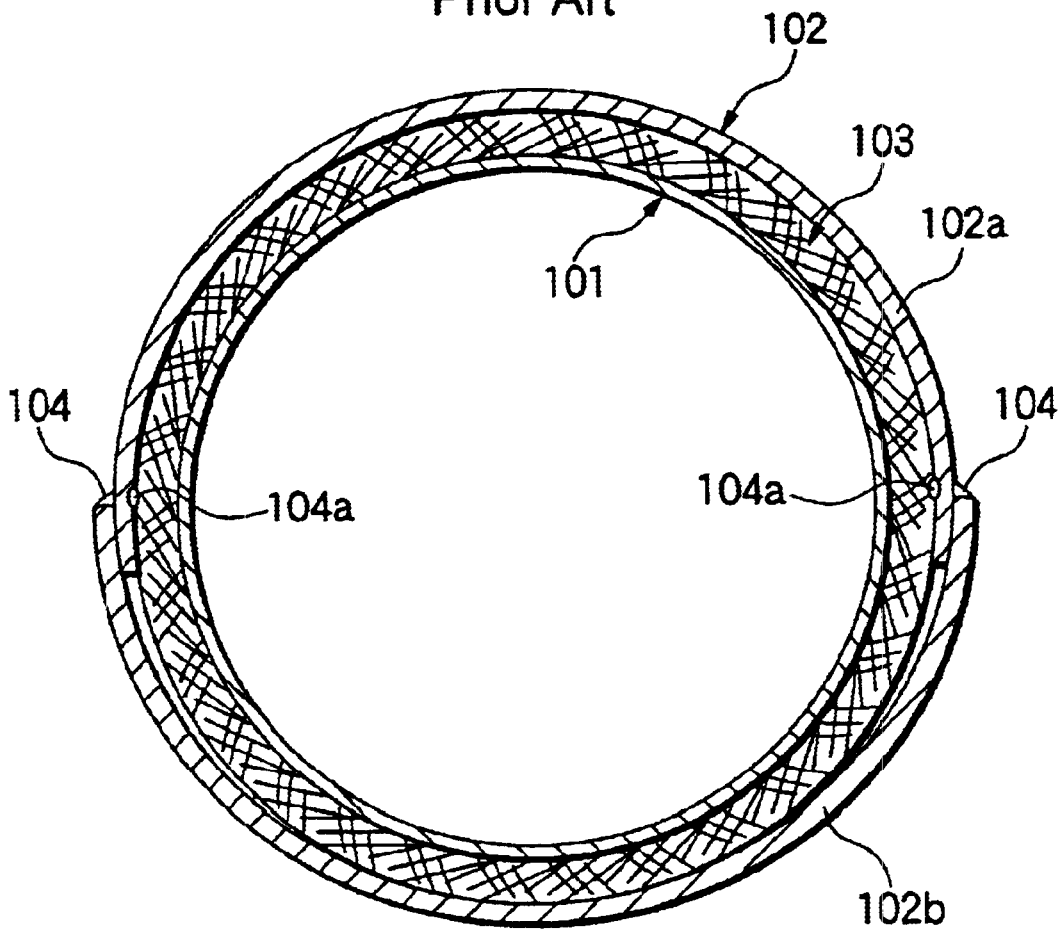
FIG.6 Prior Art
[FIG. 6]

For example, in the above embodiment, the cylindrical member is used as it is for the mesh spacer member 6. If required, two members, each being crushed semicircular, are combined into a cylindrical member as shown FIG. 5, and the resultant member may be used for the mesh spacer member.

What is claimed is:

1. A double pipe exhaust manifold comprising:

an inner pipe, a mesh spacer member applied to the outer periphery of said inner pipe, and an outer pipe divided into two pipe members in a radial direction, which is disposed around the outer periphery of said mesh spacer member in a state that said outer pipe is axially slidable at least to said inner pipe, wherein both side ends of one of said divided pipe members and of the other are put on together in a radial direction, and overlapping portions thereof being welded together, and wherein said overlapping portions of said pipe members are swollen to the outside to form gaps between said overlapping portions and said mesh spacer member.

2. The double pipe exhaust manifold according to claim 1, wherein said inner pipe is thinner than said outer pipe, and said mesh spacer member is fastened to said inner pipe by spot welding.

3. The double pipe exhaust manifold according to claim 1, wherein said mesh spacer member includes two members, each of which are crushed semicircular and are combined into a cylindrical member.

4. The double pipe exhaust manifold according to claim 1, wherein gaps between said overlapping portions of said divided outer pipe members and said mesh spacer member are about 2 mm.

5. The double pipe exhaust manifold according to claim 1, wherein said inner pipe is formed with a pipe member, circular in cross section.

6. The double pipe exhaust manifold according to claim 1, wherein said inner and outer pipes are made of stainless steel.

7. The double pipe exhaust manifold according to claim 1, wherein said inner pipe has a thin thickness of 0.5 to 0.8 mm.

8. The double pipe exhaust manifold according to claim 1, wherein said outer pipe has a thin thickness of 1.5 to 2.0 mm.

9. The double pipe exhaust manifold according to claim 1, wherein said mesh spacer member is formed by wires each having a small diameter of about 0.25 mm.

10. The double pipe exhaust manifold of claim 1, wherein a portion of said mesh spacer member is disposed between welded regions of said overlapping portions and said inner pipe.

11. The double pipe exhaust manifold of claim 1, wherein an inner diameter of said outer pipe at the overlapping portions is swollen to the outside.

12. The double pipe exhaust manifold of claim 1, wherein said mesh spacer is disposed between said inner pipe and said outer pipe so as to have a fully circular shape with no gaps.

* * * * *